United States Patent [19]

Tanikawa et al.

[11] Patent Number: 4,596,065

[45] Date of Patent: Jun. 24, 1986

[54] METHOD OF PRODUCING AN AIRTIGHT AND WATERPROOF SLIDE FASTENER

[75] Inventors: Koichi Tanikawa; Toshiaki Takizawa, both of Toyama, Japan

[73] Assignee: Yoshida Kogyo K. K., Tokyo, Japan

[21] Appl. No.: 730,541

[22] Filed: May 6, 1985

[30] Foreign Application Priority Data

May 19, 1984 [JP] Japan ..... 59-102801

[51] Int. Cl.[4] ..... B21D 53/50; A41H 37/06

[52] U.S. Cl. ..... 29/408; 29/33.2

[58] Field of Search ..... 24/389; 29/33.2, 408–410, 29/766–770

[56] References Cited

U.S. PATENT DOCUMENTS

| | | | |
|---|---|---|---|
| 2,928,127 | 3/1960 | Armstrong | 24/389 |
| 3,501,816 | 3/1970 | Heimberger | 24/389 |
| 3,764,437 | 10/1973 | Heimberger | 24/389 |
| 3,874,037 | 4/1975 | Takamatsu | 24/389 |
| 4,327,470 | 5/1982 | Lawrence | 29/408 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A method of producing a slide fastener wherein a series of fastener elements are secured to each of a pair of fastener tapes along one edge each thereof, each said fastener tape is formed thereon with a waterproof sealing layer, and when said series of fastener elements on each said pair of fastener tapes are engaged with each other, the edges of said waterproof sealing layers on each said pair of fastener tapes are press-contacted with each other so as to provide airtightness and waterproofness. The improvement comprises forming said pair of fastener tapes in one piece with a thin connecting portion therebetween, securing a pair of said series of fastener elements to one side of said pair of fastener tapes formed in one piece on the edges along both sides of said connecting portion so that they face each other without being engaged with each other, applying a resiliently deformable waterproof sealing layer all over the other side of said pair of fastener tapes formed in one piece including said connecting portion, then cutting said pair of fastener tapes formed in one piece away from each other longitudinally along said connecting portion so that each cut edge of said waterproof sealing layer projects over a line which will become the center line of engagement of said pair of series of fastener elements when they are engaged with each other. The above method according to the invention produces an airtight and waterproof slide fastener in a simplified manner without impairing the engaging function of the slide fastener and without rendering any damage to the fastener elements.

12 Claims, 17 Drawing Figures

METHOD OF PRODUCING AN AIRTIGHT AND WATERPROOF SLIDE FASTENER

BACKGROUND OF THE INVENTION

The present invention relates to a method of producing an airtight and waterproof slide fastener, and more specifically to a method of producing a slide fastener wherein a series of fastener elements are secured to each of a pair of fastener tapes along one edge each thereof, each said fastener tape is formed thereon with a waterproof sealing layer, and when said series of fastener elements on each said pair of fastener tapes are engaged with each other, the edges of said waterproof sealing layers on each said pair of fastener tapes are press-contacted with each other so as to provide airtightness and waterproofness.

DESCRIPTION OF THE PRIOR ART

A method of producing an airtight and waterproof slide fastener has been shown, for example, in U.S. Pat. No. 3,501,816. Please refer to FIG. 16 and FIG. 17. As shown in FIG. 16, first, fastener elements "b" are secured to each of a pair of fastener tapes "c". Then, fastener elements on the pair of fastener tapes are engaged with each other with one fastener tape being held upside down. The fastener tapes in engaged position are passed through a synthetic resin extrusion die so that waterproof sealing layer "a" is applied onto each fastener stringer. Then, a pair of fastener stringers are separated from each other by cutting the portions above and below the fastener elements engaging portion. The separated fastener stringers are then engaged with each other in normal position, as shown in FIG. 17. In this way an airtight and waterproof slide fastener is completed.

The above-mentioned method, however, has involved the following problems:

(1) When applying a waterproof sealing layer, sealing material tends to enter into the engaging portion, which impairs the engaging function of fastener elements.

(2) When cutting the portions above and below the fastener elements engaging portion, fastener tapes and fastener elements tend to be damaged.

Thus, the production of an airtight and waterproof slide fastener was not easy and needed to be carried out very carefully.

SUMMARY OF THE INVENTION

It is an object of the present invention, therefore, to provide a method of producing an airtight and waterproof slide fastener in which the engaging function of the slide fastener is not impaired by the penetration of sealing material into the engaging portion when the waterproof sealing layer is applied.

Another object of the present invention is to provide a method of producing an airtight and waterproof slide fastener in which fastener tapes and the engaging portion of the fastener elements are not damaged when cutting the portions above and below the fastener elements.

A further object of the present invention is to provide a method of producing an airtight and waterproof slide fastener which can be carried out in a simplified manner.

These and other objects have been attained in a method of producing a slide fastener wherein a series of fastener elements are secured to each of a pair of fastener tapes along one edge each thereof, each said fastener tape is formed thereon with a waterproof sealing layer, and when said series of fastener elements on each said pair of fastener tapes are engaged with each other, the edges of said waterproof sealing layers on each said pair of fastener tapes are press-contacted with each other so as to provide airtightness and waterproofness, by forming said pair of fastener tapes in one piece with a thin connecting portion therebetween, securing a pair of said series of fastener elements to one side of said pair of fastener tapes formed in one piece on the edges along both sides of said connecting portion so that they face each other without being engaged with each other, applying a resiliently deformable waterproof sealing layer all over the other side of said pair of fastener tapes formed in one piece including said connecting portion, then cutting said pair of fastener tapes formed in one piece away from each other longitudinally along said connecting portion so that each cut edge of said waterproof sealing layer projects over a line which will become the center line of engagement of said pair of series of fastener elements when they are engaged with each other.

Since the present invention is constructed as described above, the method of producing an airtight and waterproof slide fastener according to the present invention brings about the following effects:

(1) Since fastener elements are secured to one side of a fastener tape, and the waterproof sealing layer is applied to the other side of the fastener tape, sealing material does not penetrate into the engaging portion of the fastener elements. For this reason the engaging function of a slide fastener is not impaired, and, as a result, satisfactory airtightness and waterproofness are obtained.

(2) Since the pair of fastener tapes formed in one piece are cut away from each other longitudinally along the connecting portion between the pair of fastener tapes so that each cut edge projects over a line which will become the center line of engagement of the pair of series of fastener elements when they are engaged with each other, the fastener tapes are easily cut away from each other without rendering any damage to the fastener elements, thereby providing right and left fastener stringers.

As described above, a high quality airtight and waterproof slide fastener can be produced easily. In addition, the above-mentioned method is suitable for the mass-production of slide fasteners.

The above and other objects and attendant advantages of the present invention will be more readily apparent to those skilled in the art from a reading of the following detailed description in conjunction with the accompanying drawings which show preferred embodiments of the invention for illustration purposes only, and which do not limit the cope of the same in any way.

DESCRIPTION OF PREFERRED EMBODIMENTS

Figure 1:
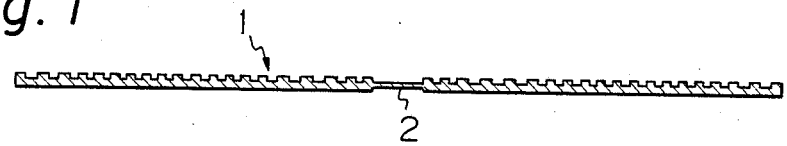
FIG. 1 shows a pair of fastener tapes formed in one piece.
Figure 2:
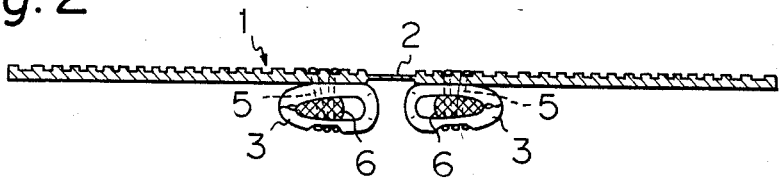
FIG. 2 shows the condition in which fastener elements have been secured to one side of the pair of fastener tapes formed in one piece.
Figure 3:
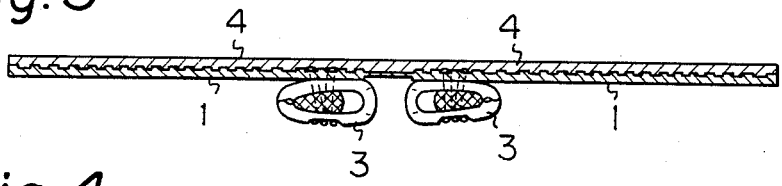
FIG. 3 shows the condition in which a waterproof sealing layer is applied to the other side of the pair of fastener tapes formed in one piece.
Figure 4:
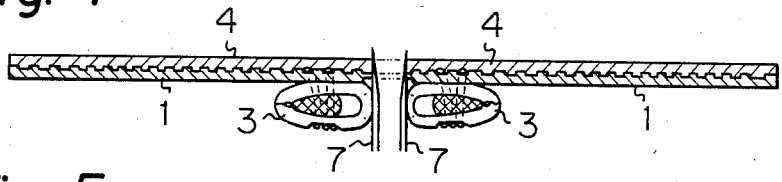
FIG. 4 shows the condition in which a connecting portion has been cut off by cutters.
Figure 5:
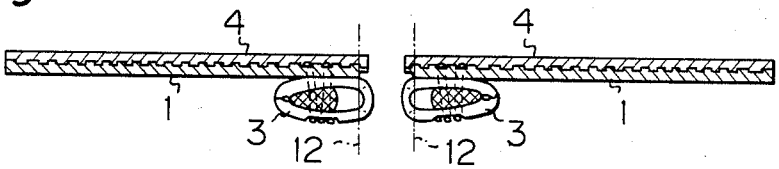
FIG. 5 shows right and left fastener stringers constructed while in the condition of being cut away from each other.
Figure 6:
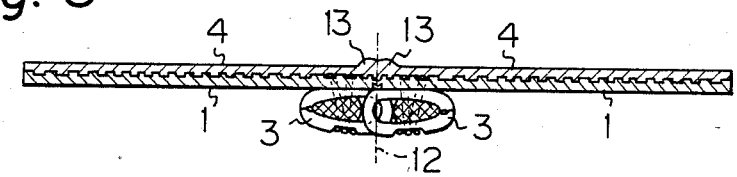
FIG. 6 shows an airtight and waterproof slide fastener chain completed by the engagement of right and left fastener stringers.
Figure 7:
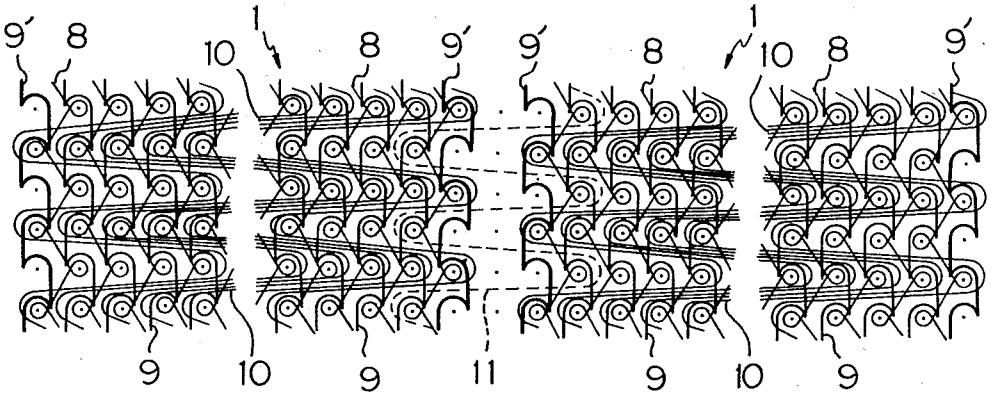
FIG. 7 shows the knitted structure of a pair of fastener tapes formed in one piece.
Figure 8:
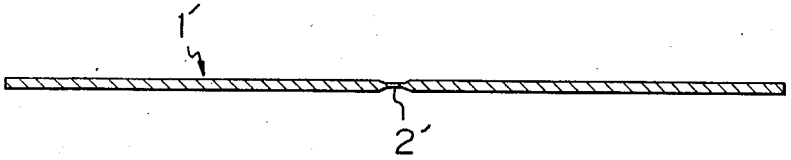
FIG. 8 shows another embodiment of a pair of fastener tapes formed in one piece.
Figure 9:
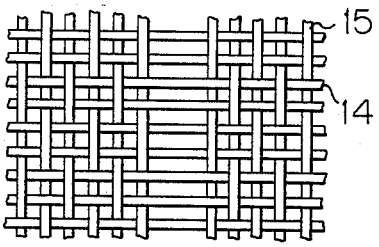
FIG. 9 shows the woven structure of a pair of fastener tapes according to FIG. 8.
Figure 10:
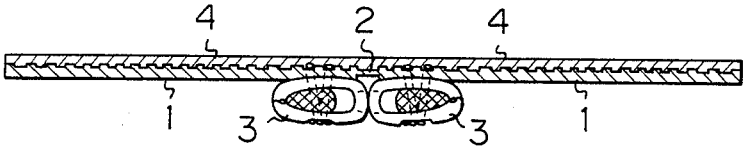
FIG. 10 shows a sectional view of another embodiment of the present invention, wherein fastener elements have been secured to one side of a pair of fastener tapes while being in contact with each other.
Figure 11:
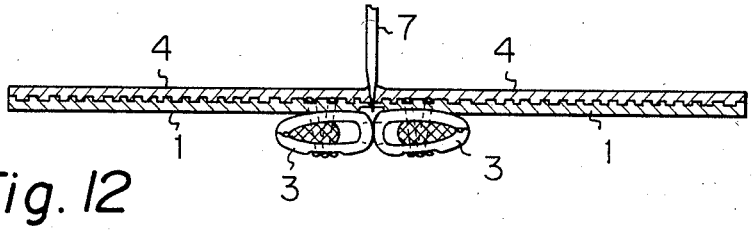
FIG. 11 shows a pair of fastener tapes according to FIG. 10 being cut away from each other.
Figure 12:
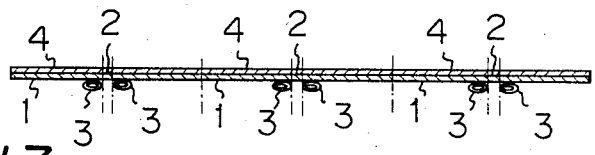
FIG. 12 shows still another embodiment of the present invention, wherein a plurality of fastener tapes have been formed in one piece with a connecting portion placed between each pair of adjacent fastener tapes, and fastener elements have been secured to one side of the fastener tapes formed in one piece on the edges along each connecting portion, followed by application of a waterproof sealing layer to the other side of the fastener tapes formed in one peice such as to cover the whole width thereof.
Figure 13:
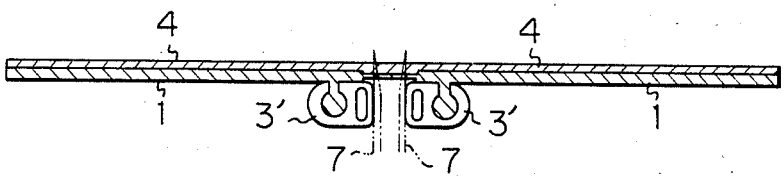
FIGS. 13, 14 and 15 show still another embodiment of the present invention, wherein fastener elements which do not have a coil-like configuration are used.
Figure 14:
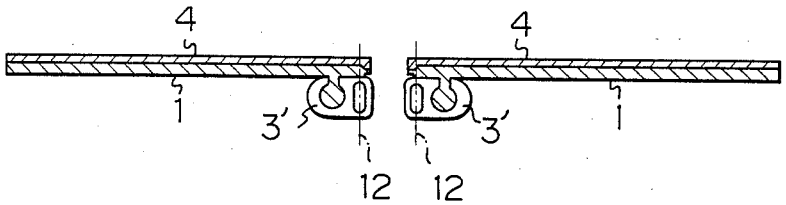
Figure 15:
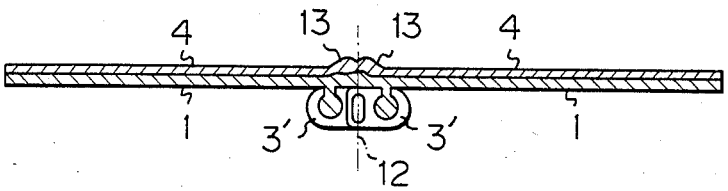
Figure 16:
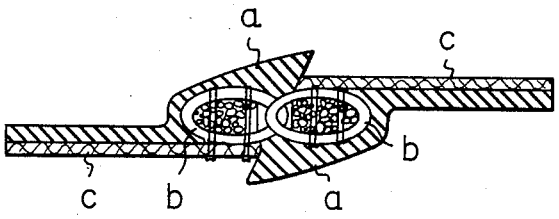
Fig. 16 PRIOR ART
FIGS. 16 and 17 show steps of a conventional slide fastener production process.
Figure 17:
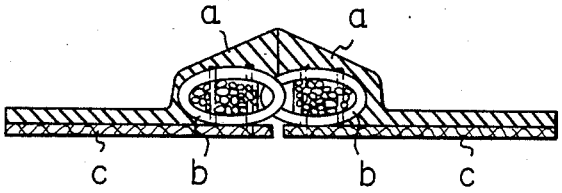
Fig. 17 PRIOR ART

FIG. 1 through FIG. 6 show each step of the production process according to the present invention. FIG. 1 shows a simplified sectional view of a pair of elongated slide fastener tapes 1 connected at their center by connecting portion 2, the fastener tapes being formed by a warp knitted structure. The knitted structure of the slide fastener tape 1 is explained in detail hereinbelow. As shown in FIG. 7, the tape portion is constructed by knitting yarn 8 of tricot texture and knitting yarn 10 of horizontally inserted structure across five wales, the knitting yarns 8 and 10 being held together by knitting yarns 9 of chain stitch structure. It is to be particularly noted that the edges of the tape are reinforced by strong knitting yarns 9'. The connecting portion 2 comprises only connecting threads 11 which are transversely passed across the gap in a zig-zag fashion. This connecting portion is thinner than the tape portion. The tapes can be constructed in a different way as shown in FIG. 8 and FIG. 9. Namely, normal woven tapes 1' consisting of warp threads 15 and weft threads 14, with the center connecting portion 2' comprising only weft threads 14, can be used as an equivalent to the above-mentioned knitted tapes. FIG. 2 shows that right and left coil-like fastener elements 3 have been sewn on the one side of the pair of fastener tapes 1 by means of core string 6 and sewing threads 5 at the edges along the connecting portion 2 of the pair of fastener tapes 1 with the right and left fastener elements 3 facing but apart from each other and not being engaged with each other. As described later, when sealing portions 13 are press-contacted with each other, the sealing portions repel each other, which tends to cause the fastener elements to slip relative to the fastener tape. It is therefore desirable to take some measures to prevent the slippage of sewing threads relative to the fastener elements. For example, it is possible to use gourd shape fastener elements or to provide a groove on the top of each fastener element so that the fastener elements are held securely by the sewing threads. In FIG. 1 through FIG. 6, fastener elements secured to fastener tape 1 are of coil type. However, other types of fastener elements can be used too, if they can be secured to one side of a fastener tape without preventing the application of a waterproof sealing layer on the other side of the fastener tape. For example, a plurality of independent fastener elements 3' may be arranged in a series which can be fitted onto portions projecting from the tape surface as shown in FIG. 13 through FIG. 15. In FIG. 3, resiliently deformable waterproof sealing material of synthetic resin such as silicone rubber, butyl rubber, neoprene or polyurethane has been coated on the pair of fastener tapes which are formed in one piece all over one side opposite to the side on which the fastener elements are secured including the connecting portion 2, and then has been dried so as to be adhered to the fastener tapes. The formation of the waterproof sealing layer can also be performed by using a hot-melt extrusion machine. If fastener elements can be secured to fastener tapes without using sewing threads by such methods as are shown, for example, in FIG. 13 through FIG. 15, it is possible to apply the waterproof sealing layer on the fastener tapes first, then to secure the fastener elements to the fastener tapes. Then, as shown in FIG. 4, connecting portions 2 are cut off by cutters 7 so as to provide separated right and left fastener stringers. The cutting position needs to be chosen in such a way that cut edges are press contacted with each other when a pair of series of fastener elements of the completed fastener stringers are engaged with each other. Namely, the cutting position must be on the outside of the center line of engagement 12 of the fastener elements (refer to FIG. 5 and FIG. 6). In other words, the cutting position must be close to the edge of the engaging head of the fastener elements. In FIG. 4, connecting portion 2 has been cut off at the engaging head position of the fastener elements. In the example shown in FIG. 13, cutting is performed in the same manner. When connecting portion 2 is cut at the engaging head of the fastener elements, an airtight and waterproof slide fastener according to the present invention can be produced more easily by the following method. Namely, connecting portion 2 is first formed over a short length between a pair of fastener tapes, and a pair of series of fastener elements, right and left, are secured to the fastener tapes while in contact with each other as shown in FIG. 10 and FIG. 11. Then the pair of fastener tapes formed in one piece are cut in one place at the position where the engaging heads of the pair of series of fastener elements are in contact with each other. In FIG. 5, a pair of fastener tapes have been cut away from each other and right and left fastener stringers have been completed. In FIG. 14, same condition is shown also. The cut edges of the fastener tapes do not become frayed due to the infiltration of waterproof sealing material into the tapes. In FIG. 6, a pair of seris of fastener elements on right and left fastener stringers have been engaged with each other. Since waterproof sealing layers 4 have been cut at positions outside the center lines 12 of engagement of the fastener elements, the cut edges are press-contacted with each other forming sealing portions 13 which are expanded out to certain degree when the pair of series of fastener elements 3 are engaged with each other. Similar expanded sealing portions 13 are observed in the engaged condition shown in FIG. 15, too. Although in the production steps shown in FIG. 1 through FIG. 6, a method of producing a pair of fastener stringers has been explained, this method can be applied in a different way as shown in FIG. 12. In FIG. 12, an elongated fastener tape 1 has been formed to have a large width with a plurality of connecting portions 2 being provided as shown. A pair of series of fastener elements 3 are secured on the edges along each connecting portion 2. A waterproof sealing layer 4 is applied onto the fastener tape 1 over its full width. The tape is then cut at a plurality of positions simultaneously by a plurality of disc cutters. According to this method shown in FIG. 12, a plurality of airtight and waterproof slide fasteners can be produced simultaneously.

What is claimed is:

1. In a method of producing a slide fastener wherein a series of fastener elements are secured to each of a pair of fastener tapes along one edge each thereof, each said fastener tape is formed thereon with a waterproof sealing layer, and when said series of fastener elements on each said pair of fastener tapes are engaged with each other, the edges of said waterproof sealing layers on each said pair of fastener tapes are press-contacted with each other so as to provide airtightness and waterproofness, the improvement comprising:

said pair of fastener tapes are formed in one piece with a thin connecting portion therebetween;

a pair of said series of fastener elements are secured to one side of said pair of fastener tapes formed in one piece on the edges along both sides of said connecting portion so that they face each other without being engaged with each other;

a resiliently deformable waterproof sealing layer is applied all over the other side of said pair of fastener tapes formed in one piece including said connecting portion;

then, said pair of fastener tapes formed in one piece are cut away from each other longitudinally along said connecting portion so that each cut edge of said waterproof sealing layer projects over a line which will become the center line of engagement of said pair of series of fastener elements when they are engaged with each other.

2. A method of producing a slide fastener according to claim 1, wherein said pair of fastener tapes are formed in one piece by knitting or weaving.

3. A method of producing a slide fastener according to claim 1 or 2, wherein said pair of series of fastener elements are secured to one side of said pair of fastener tapes formed in one piece on the edges along both sides of said connecting portion while being apart from each other, and said pair of fastener tapes formed in one piece are cut in two places longitudinally along said connecting portion.

4. A method of producing a slide fastener according to claim 1 or 2, wherein said pair of series of fastener elements are secured to one side of said pair of fastener tapes formed in one piece on the edges along both sides of said connecting portion while being in contact with each other, and said pair of fastener tapes formed in one piece are cut in one place longitudinally along said connecting portion.

5. A method of producing a slide fastener according to claim 1 or 2, wherein said pair of series of fastener elements are sewn on the one side of said pair of fastener tapes formed in one piece by means of core string and sewing threads.

6. A method of producing a slide fastener according to claim 5, wherein said waterproof sealing layer is applied all over the other side of said pair of fastener tapes formed in one piece after said pair of series of fastener elements are sewn on the one side of said pair of fastener tapes formed in one piece.

7. A method of producing a slide fastener according to claim 1 or 2, wherein said pair of series of fastener elements are fitted onto portions projecting from the one side of said pair of fastener tapes formed in one piece.

8. A method of producing a slide fastener according to claim 7, wherein said waterproof sealing layer is applied all over the other side of said pair of fastener tapes formed in one piece before or after said pair of series of fastener elements are fitted onto the portions projecting from the one side of said pair of fastener tapes formed in one piece.

9. A method of producing a slide fastener according to claim 1 or 2, wherein said waterproof sealing layer comprises silicone rubber, butyl rubber, neoprene or polyurethane.

10. A method of producing a slide fastener according to claim 1 or 2, wherein said series of fastener elements comprise coil-like continuous elements.

11. A method of producing a slide fastener according to claim 1 or 2, wherein said series of fastener elements comprise a plurality of independent elements.

12. A method of producing a slide fastener according to claim 1, wherein the procedures described in claim 1 are followed simultaneously in a plurality of places on a plurality of fastener tapes formed in one piece.

* * * * *